US006386962B1

(12) United States Patent
Gotkis et al.

(10) Patent No.: US 6,386,962 B1
(45) Date of Patent: May 14, 2002

(54) WAFER CARRIER WITH GROOVE FOR DECOUPLING RETAINER RING FROM WATER

(75) Inventors: Yehiel Gotkis, Fremont; Aleksander A. Owczarz, San Jose, both of CA (US)

(73) Assignee: Lam Research Corporation, Fremont, CA (US)

( * ) Notice: Subject to any disclaimer, the term of this patent is extended or adjusted under 35 U.S.C. 154(b) by 0 days.

(21) Appl. No.: 09/608,510

(22) Filed: Jun. 30, 2000

(51) Int. Cl.[7] ..... B24B 47/00
(52) U.S. Cl. ..... 451/388; 451/289
(58) Field of Search ..... 451/289, 287, 451/288, 388, 397, 398, 402, 285, 41, 63

(56) References Cited

U.S. PATENT DOCUMENTS 5,795,215 A * 8/1998 Guthrie et al. ..... 451/289
5,851,140 A * 12/1998 Barns et al. ..... 451/289
5,906,532 A * 5/1999 Nakajima et al. ..... 451/289

FOREIGN PATENT DOCUMENTS

EP 0776730 A1 4/1997 ..... B24B/37/04
EP 0861706 A1 2/1998 ..... B24B/37/04
WO WO 00/27584 5/2000 ..... B24B/1/00

* cited by examiner

*Primary Examiner*—Derris H. Banks
(74) *Attorney, Agent, or Firm*—Martine & Penilla, LLP

(57) ABSTRACT

The present invention provides a wafer carrier for use with a chemical mechanical planarization apparatus. The wafer carrier includes a vacuum chuck and a retainer ring. The vacuum chuck is configured to hold and rotate a wafer for planarizing a surface topography of the wafer on a polishing pad. The vacuum chuck includes an inner region for holding the wafer and an outer region and further has a groove adapted to decouple the inner region and the outer region. The inner and outer regions of the vacuum chuck are arranged to move independently in a direction orthogonal to a polishing surface of the polishing pad. The retainer ring is disposed on the outer region of the vacuum chuck and is configured to retain the wafer during CMP processing. In this configuration, the decoupled retainer ring and the wafer are arranged to move independently to align to the polishing surface of the polishing pad during CMP processing.

18 Claims, 5 Drawing Sheets

WAFER CARRIER WITH GROOVE FOR DECOUPLING RETAINER RING FROM WATER

BACKGROUND OF THE INVENTION

1. Field of the Invention

The present invention relates to chemical mechanical planarization (CMP), and more particularly to wafer carriers for reducing edge effects during wafer processing by CMP.

2. Description of the Related Art

Fabrication of semiconductor devices from semiconductor wafers generally requires, among others, chemical mechanical planarization (CMP), buffing, and cleaning of the wafers. Modem integrated circuit devices typically are formed in multi-level structures. At the substrate level, for example, transistor devices are formed. In subsequent levels, interconnect metallization lines are patterned and electrically connected to the transistor devices to define the desired functional device. As is well known, patterned conductive features are insulated from each other by dielectric material, such as silicon dioxide, for example. As more metallization levels and associated dielectric layers are formed, the need to planarize the dielectric material increases. Without planarization, fabrication of additional metallization layers becomes substantially more difficult due to the higher variations in the surface topography. In other applications, metallization line patterns are formed in the dielectric material, and then metal CMP operations are performed to remove excessive metallization.

FIG. 1 shows a schematic diagram of a chemical mechanical planarization (CMP) process 100 performed on a semiconductor wafer 102. In this process 100, the wafer 102 undergoes a CMP process in a CMP system 104. Then, the semiconductor wafer 102 is cleaned in a wafer cleaning system 106. The semiconductor wafer 102 then proceeds to a post-CMP processing 108, where the wafer 102 undergoes different subsequent fabrication operations, including deposition of additional layers, sputtering, photolithography, and associated etching.

The CMP system 104 typically includes system components for handling and planarizing the surface topography of the wafer 102. Such components can be, for example, an orbital or rotational polishing pad, or a linear belt-polishing pad. The pad itself is typically made of an elastic polymeric material. For planarizing the surface topography of the wafer 102, the pad is put in motion and a slurry material is applied and spread over the surface of the pad. Once the pad with the slurry is moving at a desired rate, the wafer 102, which is mounted on a wafer carrier, is lowered onto the surface of the pad for planarizing the topography of the wafer surface.

In rotational or orbital CMP systems, a polishing pad is located on a rotating planar surface, and the slurry is introduced onto the polishing pad. In orbital tools the velocity is introduced via pad orbital motion and wafer carrier rotation and the slurry is introduced from underneath the wafer through multiple holes in the polishing pad. Through these processes, a desired wafer surface is polished to provide a smooth planar surface. The wafer is then provided to the wafer cleaning system 106 to be cleaned.

One of the main goals of CMP systems is to ensure the uniform removal rate distribution across the wafer surface. As is well known, the removal rate is defined by Preston's equation: Removal Rate=KpPV, where the removal rate of material is a function of loading pressure P and relative velocity V. The term, Kp, is Preston Coefficient, which is a constant determined by the composition of the slurry, the process temperature, and the pad surface.

Unfortunately, conventional CMP systems often suffer from edge effects that redistribute the removal rate and thus the uniformity across the wafer surface. The edge effects typically result from boundary conditions between a wafer edge and a polishing pad during CMP processing. FIG. 2A shows a cross-sectional view of a static model of conventional edge effect between a section of the wafer 102 and a polishing pad 204. In this static model, a uniform pressure is exerted on the wafer 102 in the form of a downforce as indicated by vectors 206. This down force 206, however, causes a deformation, which is indicated by vectors 112, of the pad 204 that is essentially transversal (i.e., normal) but with a substantial longitudinal-transversal perturbation zone near the edge 208 of the wafer 102. Thus, this deformation results in a lower pressure zone 110 near the edge 208. The edge 208 of the wafer 102 causes high pressure as indicated by vectors 111, thereby producing non-uniform pressure areas near the edge 208.

The creation of alternating pressure zones leads to non-uniform removal rate across the wafer. FIG. 2B illustrates a cross-sectional view of a dynamic model of the edge effect between a section of the wafer 102 and the polishing pad 204. A section of a retaining ring 116 retains the wafer 102 in place to retain the wafer 102 in a wafer carrier (not shown) that controls the movement of the wafer 102. In this configuration, the wafer 102 is in motion relative to the polishing pad 204 as indicated by vector $V_{rel}$. The pad 204 is generally elastic. As the wafer 102 moves with the relative velocity $V_{rel}$ over the pad 204, it thus causes elastic perturbation on the surface of the pad 204.

The translational motion of the wafer 102 and the elastic perturbation produce a longitudinal-transversal pad deformation wave on the surface 114 of the polishing pad 204 according to conventional wave generation theory. The deformation wave is typically a fast relaxing wave due to suppressive action of the extended wafer surface and the high viscosity of the pad material. This causes local redistribution of the loading and pressures near the edge 208 of the wafer 102. For example, low pressure zones 120, 122, and 124 are formed on the surface 114 of the pad 204 with progressively higher pressures relative to the distance from the edge 208 of the wafer 102.

Each of the low pressure zones 120, 122, and 124 is defined by local minimum and maximum pressure regions that cause uneven planarization of the surface topography. For example, the local minimum pressure region 126 of the low pressure zone 120 causes lower removal rates, resulting in local under-planarization of the surface topography. Conversely, the local maximum pressure region 128 of the low pressure zone 120 causes higher removal rates, resulting in local over-planarization of the surface topography. Thus, the overall planarization efficiency of the wafer 102 is substantially degraded.

Furthermore, in conventional CMP systems the frontal wave maximum produces sealing effect at the edge of a wafer that substantially reduces entry of slurry under the wafer. FIG. 2C shows a cross-sectional view of a sealing effect between a section of the wafer 102 and the polishing pad 204. The slurry is initially provided over the surface 114 of the polishing pad 204. As the wafer 102 moves with velocity Vrel relative to the polishing pad 204, the edge 208 of the wafer causes a high pressure as indicated by vector 152. This high pressure causes loading concentration of the slurry 150 at the edge 208 of the wafer 102, thereby restricting slurry transport underneath the wafer 102. In addition, high loading at the edge 208 may squeeze out the slurry out of pores and grooves of the polishing pad 204, creating slurry starvation conditions. As a result, internal sections of the wafer surface may not be provided with adequate amount of slurry for effective CMP processing.

Additionally, low pressure zones stimulate redeposition processes that can cause increased surface defectivity. Specifically, conventional CMP systems utilize dissolution and surface modification reactions, which are typically reducing volume type reactions stimulated by high pressure. In these reactions, pressure drops reverse the reaction, causing redeposition of dissolved by-products back to the wafer surface. Re-deposited material typically has uncontrollable composition and glues other particles to the wafer surface. This makes cleaning of the wafer substantially more difficult.

In view of the foregoing, what is needed is a wafer carrier that can minimize edge effects on a wafer during CMP processing while reducing slurry sealing effect.

SUMMARY OF THE INVENTION

Broadly speaking, the present invention fills these needs by providing a wafer carrier that provides uniform removal rates by masking the edge of a wafer to be polished. The wafer carrier allows a retainer ring and a wafer to independently align to the surface of a polishing pad to substantially eliminate detrimental edge and sealing effects. It should be appreciated that the present invention can be implemented in numerous ways, including as a process, an apparatus, a system, a device or a method. Several inventive embodiments of the present invention are described below.

In one embodiment, the present invention provides a wafer carrier for use with a chemical mechanical planarization apparatus. The wafer carrier includes a vacuum chuck and a retainer ring. The vacuum chuck is configured to hold and rotate a wafer for planarizing a surface topography of the wafer on a polishing pad. The vacuum chuck includes an inner region for holding the wafer and an outer region and further includes a groove adapted to decouple the inner region and the outer region. The inner and outer regions of the vacuum chuck are arranged to move independently in a direction orthogonal to a polishing surface of the polishing pad. The retainer ring is disposed on the outer region of the vacuum chuck and is configured to retain the wafer during CMP processing. In this configuration, the decoupled retainer ring and the wafer are arranged to move independently to align to the polishing surface of the polishing pad during CMP processing.

In another embodiment, a wafer carrier for use with a chemical mechanical planarization apparatus is disclosed. The wafer carrier includes a vacuum chuck and a retainer ring. The vacuum chuck is configured to hold and rotate a wafer for planarizing a surface topography of the wafer on a polishing pad and includes an inner region for holding the wafer and an outer region. The vacuum chuck is elastomeric and includes a groove adapted to decouple the inner region and the outer region. The inner and outer regions of the vacuum chuck are arranged to move independently in a direction orthogonal to a polishing surface of the polishing pad. The retainer ring is disposed on the outer region of the vacuum chuck and is configured to retain the wafer during CMP processing. The decoupled retainer ring and the wafer are arranged to move independently to align to a plane defining the polishing surface of the polishing pad during CMP processing.

In yet another embodiment, the present invention provides a wafer carrier for use with a chemical mechanical planarization apparatus. The wafer carrier includes a vacuum chuck, a retainer ring, and a vacuum port. The vacuum chuck is configured to hold and rotate a wafer for polishing the wafer on a polishing pad and includes an inner region for holding the wafer and an outer region. The vacuum chuck further includes a groove adapted to decouple the inner region and the outer region, wherein the inner and outer regions of the vacuum chuck are arranged to move independently of each other. The vacuum port is configured to provide a vacuum force to the vacuum chuck. The retainer ring is disposed on the outer region of the vacuum chuck and is configured to retain the wafer during CMP processing. In this configuration, the decoupled retainer ring and the wafer are arranged to move independently in a direction orthogonal to the polishing surface of the polishing pad such that the retainer ring and the wafer align to the polishing surface of the polishing pad.

Advantageously, the decoupled retainer ring effectively masks the edge of the wafer to minimize detrimental edge effects on the wafer during CMP processing and improves uniform removal rate. Preferably, the leading edge of the retaining is shaped in a rounded fashion to reduce the pressure so that the formation low pressure zones under the retaining ring 304 is minimized. This also minimizes the undesirable slurry sealing effect and further enhances uniform removal rate, thereby enhancing the uniform planarization of the wafer. Other aspects and advantages of the present invention will become apparent from the following detailed description, taken in conjunction with the accompanying drawings, illustrating by way of example the principles of the present invention.

BRIEF DESCRIPTION OF THE DRAWINGS

The present invention will be readily understood by the following detailed description in conjunction with the accompanying drawings. To facilitate this description, like reference numerals designate like structural elements.

DETAILED DESCRIPTION OF THE PREFERRED EMBODIMENTS

The present invention provides a wafer carrier that decouples a retainer ring from a wafer during CMP processing to allow the retainer ring and the wafer to automatically align to the polishing surface of a polishing pad. In the following description, numerous specific details are set forth in order to provide a thorough understanding of the present invention. It will be understood, however, to one skilled in the art, that the present invention may be practiced without some or all of these specific details. In other instances, well known process operations have not been described in detail in order not to unnecessarily obscure the present invention.

Figure 1:
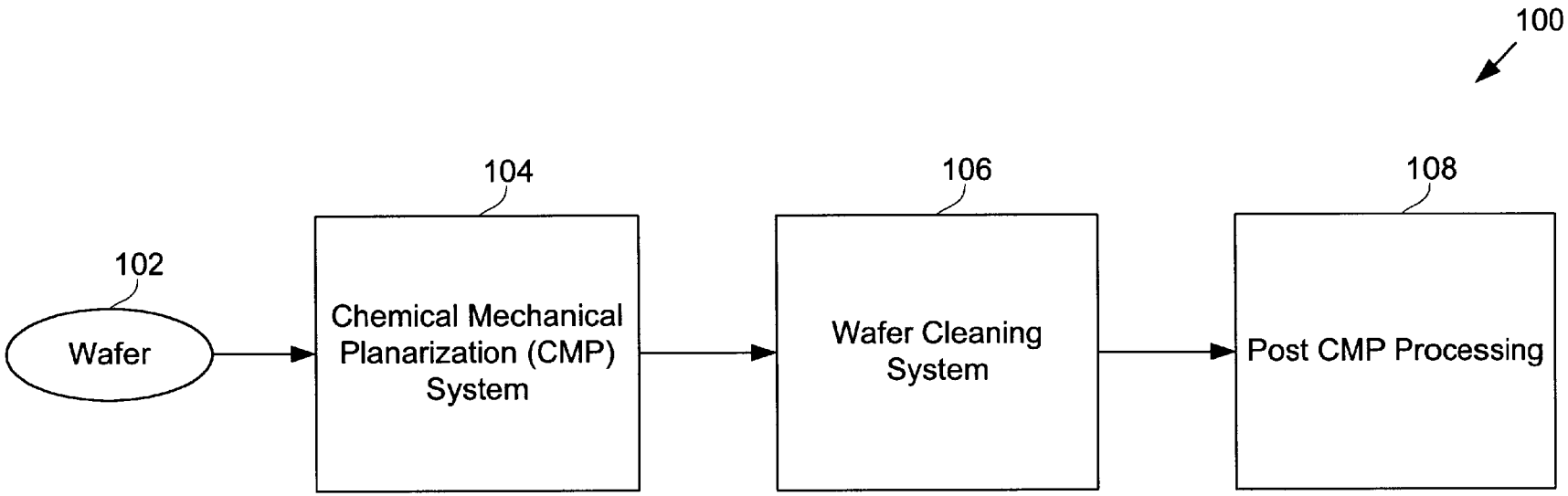
FIG. 1 shows a schematic diagram of a chemical mechanical planarization (CMP) process performed on a semiconductor wafer.
Figure 2A:
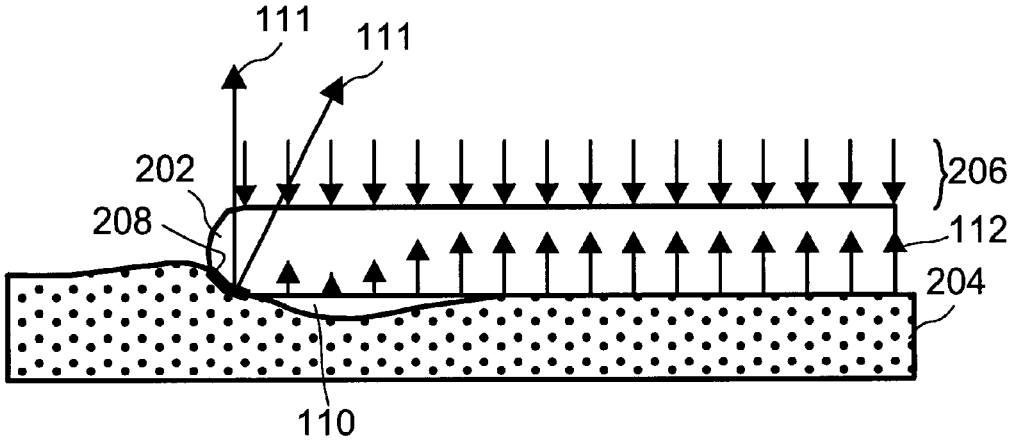
FIG. 2A shows a cross-sectional view of a static model of conventional edge effect between a section of the wafer and a polishing pad.
Figure 2B:
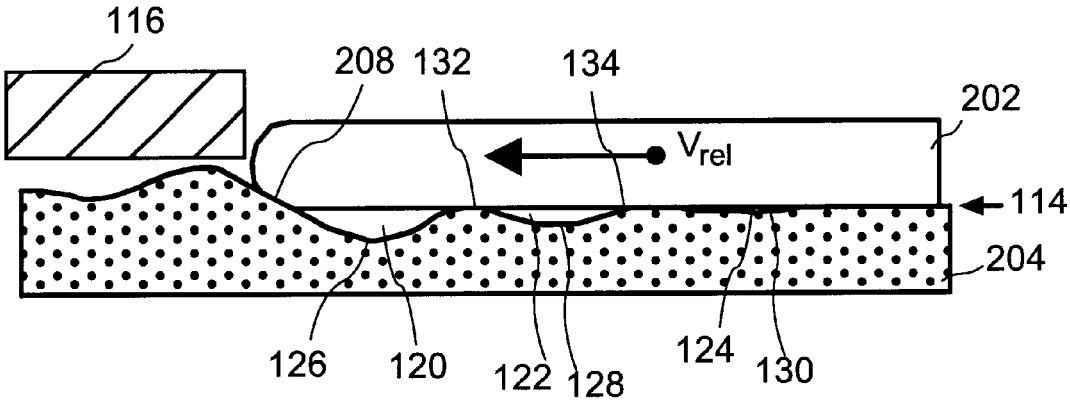
FIG. 2B illustrates a cross-sectional view of a dynamic model of the edge effect between a section of the wafer and the polishing pad.
Figure 2C:
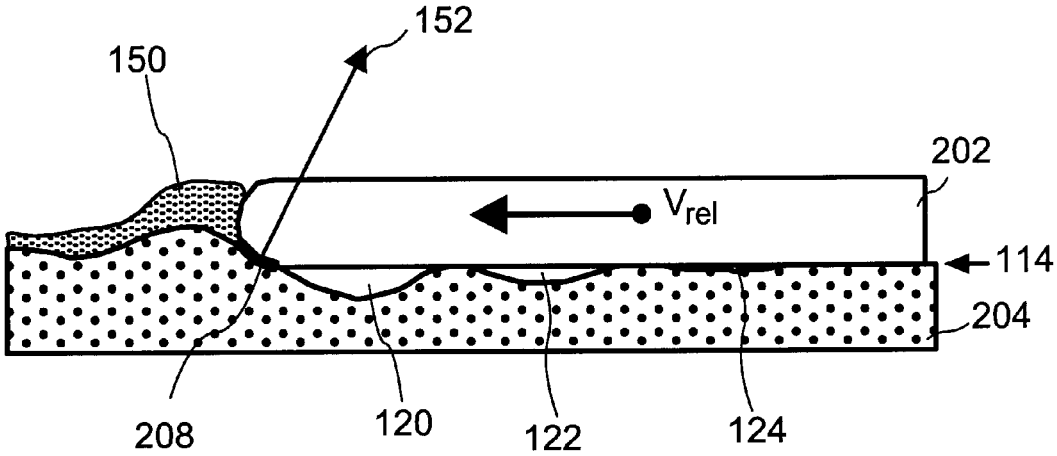
FIG. 2C shows a cross-sectional view of a sealing effect between a section of the wafer and the polishing pad.
Figure 3A:
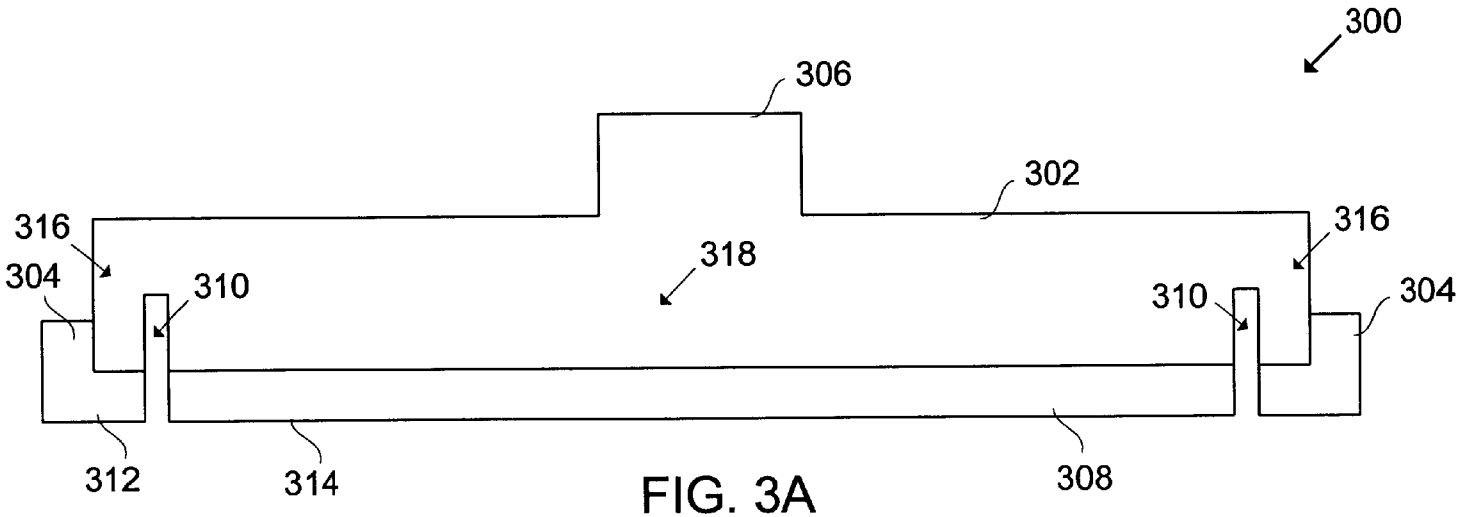
FIG. 3A shows a cross sectional view of an exemplary wafer carrier in accordance with one embodiment of the present invention.

FIG. 3A shows a cross sectional view of an exemplary wafer carrier 300 in accordance with one embodiment of the present invention. The wafer carrier 300 is configured to hold and rotates a wafer 308 during CMP processing. Specifically, the wafer carrier includes a vacuum chuck 302, an active retaining ring 304, and a vacuum port 306. The vacuum chuck 302 is preferably circular and elastic, and is made of an elastic material such as rubber. The retaining ring 304 is disposed around the elastomeric vacuum chuck 302 to retain a wafer 308 in place during CMP processing. Preferably, the retaining ring 304 is arranged such that its bottom surface 312 is substantially flush or even with a surface 314 of the wafer to be polished.

A decoupling groove 310 (e.g., trench, channel, etc.) is formed near the outer edge of the vacuum chuck 302 and defines a pair of regions 316 and 318 in the vacuum chuck 302. The retaining ring 304 is disposed on region 316, which lies along the outer edge of the vacuum chuck 302. The wafer is disposed on region 318 on the inner region of the vacuum chuck 302 by a vacuum force provided through the vacuum port 306.

In this configuration, the decoupling groove 310 is configured to effectively decouple the regions 316 and 318 in the elastomeric vacuum chuck 302. The decoupling of the regions 316 and 318 allows the attached retaining ring 304 and the wafer 308 to align independently to the plane of a polishing surface on a polishing pad. This is because the elasticity of the vacuum chuck 302 allows the wafer 308 and the retaining ring 304 to move independent of each other in a direction orthogonal to the wafer 308. Thus decoupled, both the retaining ring 304 and the wafer 308 can be independently aligned to the polishing surface under polishing pressure. As will be discussed in more detail below, this self-aligning feature of the retaining ring 304 and the wafer 308 effectively masks the edge of the wafer 308 during CMP processing, thereby substantially eliminating the undesirable edge effects.

Figure 3B:
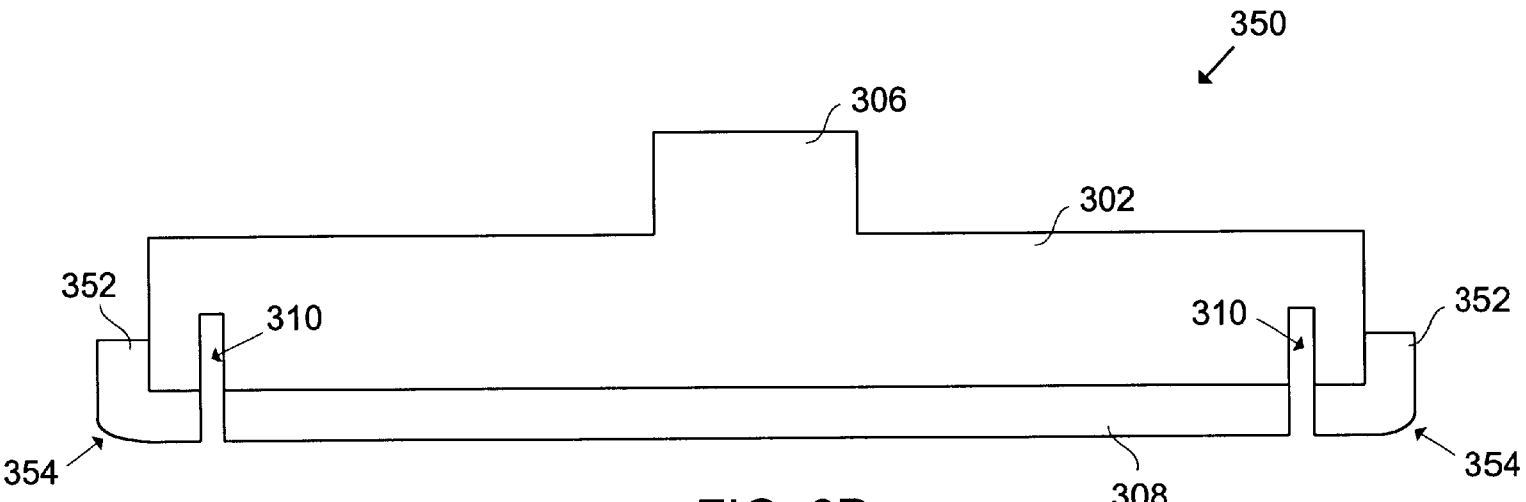
FIG. 3B illustrates a cross-sectional view of a wafer carrier with a modified retaining ring in accordance with one embodiment of the present invention.

To further ensure elimination of residual edge effects, the retaining ring 304 may be configured to suppress edge effects that may arise from the edge of the ring 304. FIG. 3B illustrates a cross-sectional view of a wafer carrier 350 with a modified retaining ring 352 in accordance with one embodiment of the present invention. The wafer carrier 350 is similar to the wafer carrier 300 shown in FIG. 3A with the exception of the retaining ring. Specifically, a leading edge 354 of the retaining ring 352 is rounded to eliminate the abrupt edge of the retaining ring 304 shown in FIG. 3A. The curvature of the rounded edge 354 of the retaining ring 352 functions to distribute pressure over a larger surface area and thus substantially reduces the ring-related edge effects.

Figure 4:
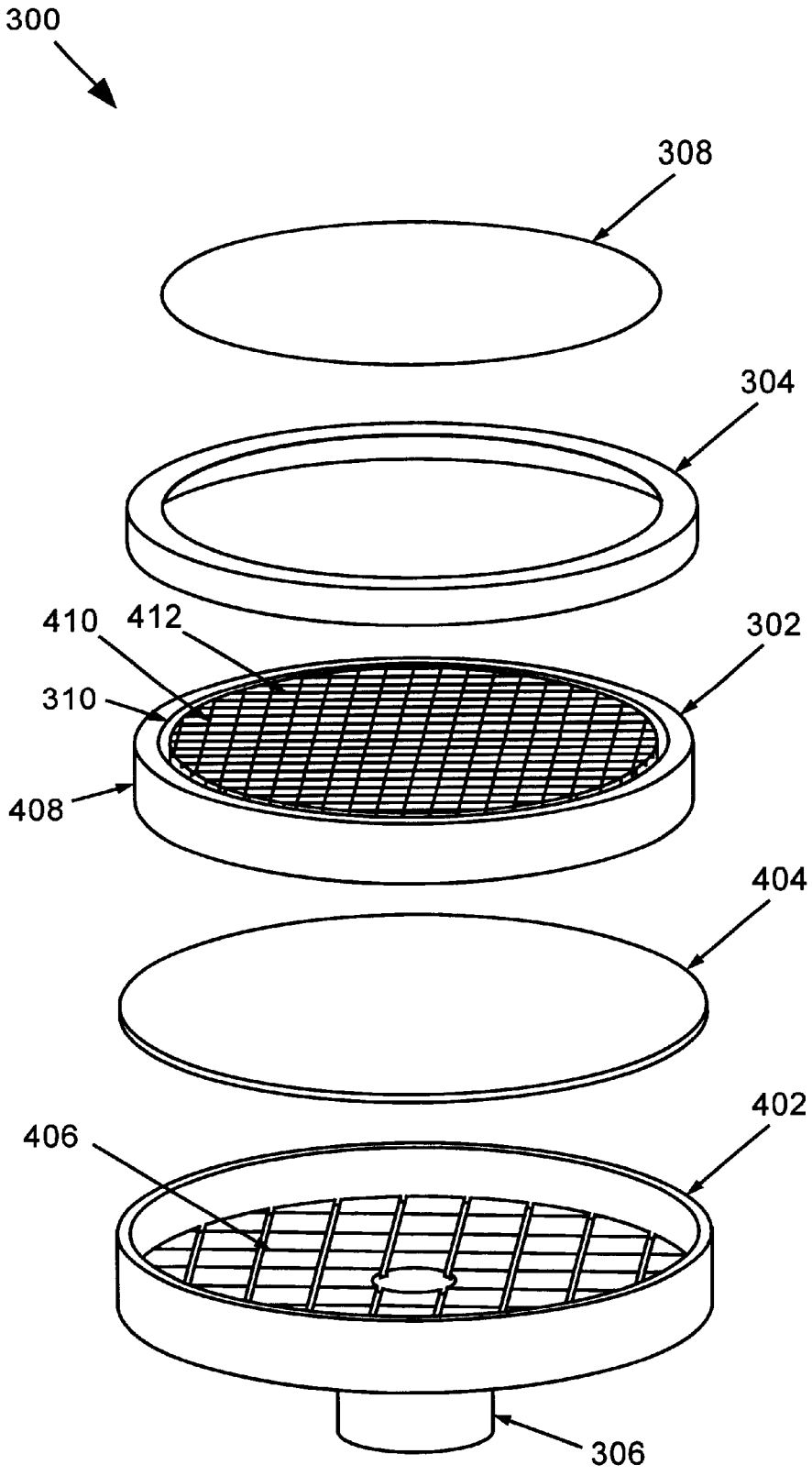
FIG. 4 shows an exploded view of the wafer carrier in accordance with one embodiment of the present invention.

FIG. 4 shows an exploded view of the wafer carrier 300 in accordance with one embodiment of the present invention. It should be noted that the wafer carriers of the present invention may be used with any suitable CMP systems such as linear CMP apparatus or rotary CMP apparatus. The wafer carrier 300 includes vacuum chuck 302, retaining ring 304, vacuum port 306, a vacuum chuck body 402, and a vacuum manifold 404. The vacuum chuck body 402 is preferably cylindrical and contains a vacuum distribution grid 406. The vacuum distribution grid 406 is configured to distribute vacuum force from the vacuum port 306. The vacuum manifold 404 is preferably made of a porous material and contains a plurality of pores. The vacuum manifold 404 is disposed over the vacuum distribution grid 406 to transfer vacuum force through the pores.

The vacuum chuck 302 is disposed on the vacuum chuck body 402 and contains a retaining ring section 408, decoupling groove 310, a wafer section 410, and a vacuum grid 412. The decoupling groove 310 decouples the retaining ring section 408 and the wafer section 410 of the vacuum chuck to provide independent alignment to a polishing pad surface. The retaining ring 304 is disposed on the retaining ring section 408 of the vacuum chuck 302. On the other hand, the wafer section 410 defines the area where the wafer 308 is attached via vacuum force. For this purpose, the vacuum grid 412 includes vacuum ports to apply vacuum pressure from the vacuum manifold 404 to the wafer 308 such that the wafer is securely kept in place within the wafer carrier 300.

Figure 5A:
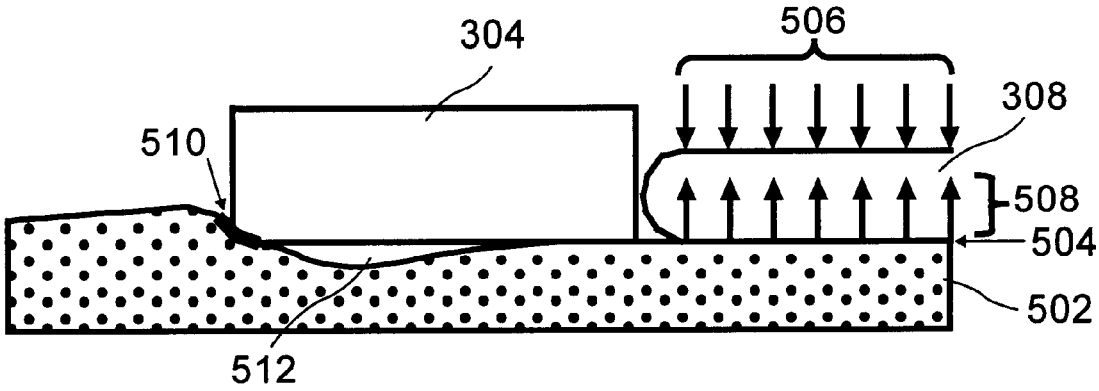
FIG. 5A shows a cross-sectional view of a section of the wafer and a retaining ring that are arranged to mask the edge effect of the wafer in accordance with one embodiment of the present invention.

FIG. 5A shows a cross-sectional view of a section of the wafer 308 and the retaining ring 304 that are arranged to mask the edge effect of the wafer 308 in accordance with one embodiment of the present invention. The wafer 308 and the retaining ring 304 are placed on a polishing pad 502. In this arrangement, the retaining ring 304 and the wafer 308 are decoupled so that both are aligned to the plane of the polishing surface 504 on the polishing pad 502. The presence of the retaining ring 304 moves the high pressure edge point away from the wafer 308 to an outside edge 510 (i.e.,leading edge) of the retaining ring 304. Likewise, the decoupled retaining ring 304 moves the low pressure zone 512 away from the wafer 308 to a location near the leading edge of the retaining ring 304. Thus, when a downforce indicated by vectors 506 is applied, the normal pressure vectors 508 under the wafer 308 are substantially uniform in magnitude and direction. In this manner, the retaining ring 304 masks the edge of the wafer 308 from undesirable edge effects by transferring the edge effect from the edge of the wafer 308 to the leading edge 510 of the retaining ring 304. Eliminating the edge effect under the wafer 308, in turn, allows slurry to be provided more evenly under the wafer 308. Accordingly, the planarization efficiency of the wafer 308 in substantially enhanced.

Figure 5B:
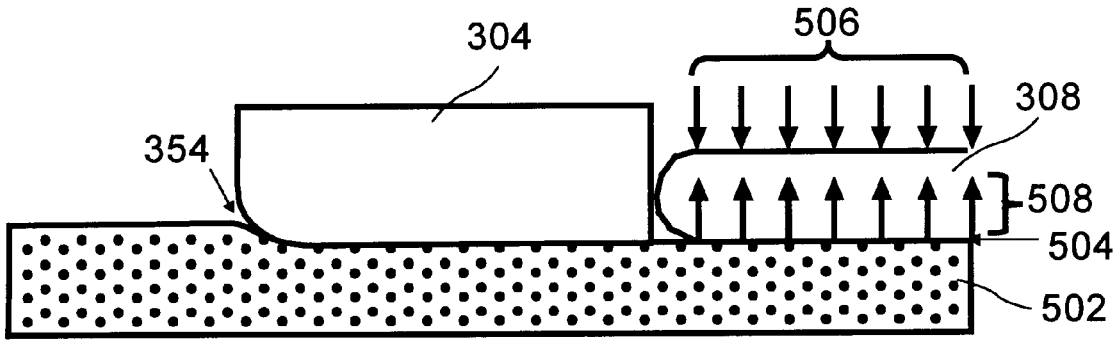
FIG. 5B shows a cross-sectional view of a section of the wafer and the retaining ring that are arranged to reduce the edge effect of the retaining ring in accordance with one embodiment of the present invention.

The leading edge 510 of the retaining ring 304 can also be configured to further improve the planarization efficiency as shown above in FIG. 3B. FIG. 5B shows a cross-sectional view of a section of the wafer 308 and the retaining ring 304 that are arranged to reduce the edge effect of the retaining ring 304 in accordance with one embodiment of the present invention. The wafer 308 and the retaining ring 304 are placed on the polishing pad 502 and are decoupled so that both are aligned to the plane of the polishing surface 504 on the polishing pad 502. The leading edge of the retaining ring 304 is shaped to minimize pressure. In the illustrated embodiment, the leading edge is rounded to reduce the pressure so that the formation low pressure zones under the retaining ring 304 is minimized. This minimizes the undesirable slurry sealing effect, thereby enhancing the uniform planarization of the wafer 508.

While the present invention has been described in terms of several preferred embodiments, it will be appreciated that those skilled in the art upon reading the preceding specifications and studying the drawings will realize various alterations, additions, permutations and equivalents thereof It is therefore intended that the present invention includes all such alterations, additions, permutations, and equivalents as fall within the true spirit and scope of the invention.

What is claimed is:

1. The wafer carrier for use with a chemical mechanical planarization apparatus, comprising:

a vacuum chuck configured to hold and rotate a wafer for planarizing a surface topography of the wafer on a polishing pad, the vacuum chuck including an inner region for holding the wafer and an outer region, the vacuum chuck having a groove adapted to decouple the inner region and the outer region, wherein the inner and outer regions of the vacuum chuck are arranged to move independently in a direction orthogonal to a polishing surface of the polishing pad; and a retainer ring disposed on the outer region of the vacuum chuck and configured to retain the wafer during CMP processing, wherein the decoupled retainer ring and the wafer are arranged to move independently to align to the polishing surface of the polishing pad during the CMP processing;

wherein the vacuum chuck is elastomeric so as to allow the decoupled retainer ring and the wafer to move independently.

2. The wafer carrier as recited in claim 1, wherein the vacuum chuck is cylindrical with a circular surface, wherein the retainer ring is disposed around the edge of the vacuum chuck in a ring configuration.

3. The wafer carrier as recited in claim 1, wherein the polishing surface defines a plane and wherein the vacuum chuck is arranged to align the decoupled retainer ring and the wafer align to the same plane of the polishing surface.

4. The wafer carrier as recited in claim 1, wherein the retaining ring is configured to mask edge effects on the wafer.

5. The wafer carrier as recited in claim 1, wherein the retaining ring includes a leading edge to mask an edge of the wafer.

6. The wafer carrier as recited in claim 5, wherein the leading edge of the retaining ring is rounded.

7. A wafer carrier for use with a chemical mechanical planarization apparatus, comprising:

a vacuum chuck configured to hold and rotate a wafer for planarizing a surface topography of the wafer on a polishing pad, the vacuum chuck including an inner region for holding the wafer and an outer region, the vacuum chuck being elastomeric and having a groove adapted to decouple the inner region and the outer region, wherein the inner and outer regions of the vacuum chuck are arranged to move independently in a direction orthogonal to a polishing surface of the polishing pad; and a retainer ring disposed on the outer region of the vacuum chuck and configured to retain the wafer during CMP processing, wherein the decoupled retainer ring and the wafer are arranged to move independently to align to a plane defining the polishing surface of the polishing pad during the CMP processing.

8. The wafer carrier as recited in claim 7, wherein the vacuum chuck is cylindrical with a circular surface, wherein the retainer ring is disposed around the edge of the vacuum chuck in a ring configuration.

9. The wafer carrier as recited in claim 7, wherein the retaining ring is configured to mask edge effects on the wafer.

10. The wafer carrier as recited in claim 7, wherein the retaining ring includes a leading edge to mask an edge of the wafer.

11. The wafer carrier as recited in claim 10, wherein the leading edge of the retaining ring is rounded.

12. The wafer carrier for use with a chemical mechanical planarization apparatus, comprising:

a vacuum chuck configured to hold and rotate a wafer for planarizing a surface topography of the wafer on a polishing pad, the vacuum chuck including an inner region for holding the wafer and an outer region, the vacuum chuck including a groove adapted to decouple the inner region and the outer region, wherein the inner and outer regions of the vacuum chuck are arranged to move independently of each other;

a retainer ring disposed on the outer region of the vacuum chuck and configured to retain the wafer during CMP processing, wherein the decoupled retainer ring and the wafer are arranged to move independently in a direction orthogonal to the polishing surface of the polishing pad such that the retainer ring and the wafer align to the polishing surface of the polishing pad; and a vacuum port configured to provide a vacuum force to the vacuum chuck;

wherein the vacuum chuck is elastomeric so as to allow the decoupled retainer ring and the wafer to move independently.

13. The wafer carrier as recited in claim 12, wherein the vacuum chuck is cylindrical with a circular surface, wherein the retainer ring is disposed around the edge of the vacuum chuck in a ring configuration.

14. The wafer carrier as recited in claim 12, wherein the polishing surface defines a plane and wherein the vacuum chuck is arranged to align the decoupled retainer ring and the wafer align to the same plane of the polishing surface.

15. The wafer carrier as recited in claim 12, wherein the retaining ring is configured to mask edge effects on the wafer.

16. The wafer carrier as recited in claim 12, wherein the retaining ring includes a leading edge to mask an edge of the wafer.

17. The wafer carrier as recited in claim 16, wherein the leading edge of the retaining ring is rounded.

18. The wafer carrier as recited in claim 12, wherein the retaining ring is formed of an elastic material.

* * * * *